US006081239A

United States Patent [19]

Sabet et al.

[11] Patent Number: 6,081,239

[45] Date of Patent: Jun. 27, 2000

[54] PLANAR ANTENNA INCLUDING A SUPERSTRATE LENS HAVING AN EFFECTIVE DIELECTRIC CONSTANT

[75] Inventors: Kazem F. Sabet; Kamal Sarabandi, both of Ann Arbor; Linda P. B. Katehi, Northville, all of Mich.

[73] Assignee: Gradient Technologies, LLC, Ann Arbor, Mich.

[21] Appl. No.: 09/178,118

[22] Filed: Oct. 23, 1998

[51] Int. Cl.[7] ..... H01Q 19/06

[52] U.S. Cl. ..... 343/753; 343/700 MS; 343/909; 343/911 R

[58] Field of Search ..... 343/753, 754, 343/911 R, 911 L, 770, 769, 767, 771, 853, 872, 700 MS, 909; 342/175

[56] References Cited

U.S. PATENT DOCUMENTS

| | | | |
|---|---|---|---|
| 3,002,190 | 9/1961 | Oleesky et al. . | |
| 3,886,558 | 5/1975 | Cary et al. . | |
| 3,914,769 | 10/1975 | Andrews | 343/911 R |
| 4,021,812 | 5/1977 | Schell et al. . | |
| 4,467,329 | 8/1984 | Thal, Jr. . | |
| 4,554,549 | 11/1985 | Fassett et al. . | |
| 5,017,939 | 5/1991 | Wu . | |
| 5,103,241 | 4/1992 | Wu . | |
| 5,177,496 | 1/1993 | Arimura et al. | 343/771 |
| 5,319,377 | 6/1994 | Thomas et al. . | |
| 5,337,058 | 8/1994 | Cross | 343/753 |
| 5,398,037 | 3/1995 | Engheta et al. . | |
| 5,497,168 | 3/1996 | Thomas et al. . | |
| 5,563,616 | 10/1996 | Dempsey et al. . | |
| 5,600,342 | 2/1997 | Pikulski et al. . | |
| 5,606,335 | 2/1997 | English et al. . | |
| 5,661,499 | 8/1997 | Epshtein et al. . | |
| 5,680,139 | 10/1997 | Huguenin et al. | 343/753 |
| 5,714,961 | 2/1998 | Kot et al. . | |
| 5,874,922 | 2/1999 | Tanaka | 343/753 |

*Primary Examiner*—Don Wong
*Assistant Examiner*—Tho Phan
*Attorney, Agent, or Firm*—Harness, Dickey & Pierce, PLC

[57] ABSTRACT

A planar antenna that includes a high dielectric constant superstrate lens having a plurality of air holes that vary the actual dielectric constant of the lens to provide an effective dielectric constant superstrate lens. The holes can take on any shape and configuration in accordance with a particular antenna design scheme so as to optimize the effective dielectric constant for a particular application. In one particular design, the holes are formed in a random manner completely through superstrate lens, and the holes have an opening diameter less than 1/20th of the operational wavelength of the antenna. The holes act to vary the dielectric constant of the superstrate lens so that the resonant waves do not form in the lens, thus reducing power loss in the antenna. The holes are formed by a suitable mechanical or laser drilling operation.

31 Claims, 4 Drawing Sheets f=1.073GHz

PLANAR ANTENNA INCLUDING A SUPERSTRATE LENS HAVING AN EFFECTIVE DIELECTRIC CONSTANT

BACKGROUND OF THE INVENTION

1. Field of the Invention

This invention relates generally to planar antennas and, more particularly, to a multifunction, compact planar antenna that includes a finite superstrate having spatially configured air voids that control the variation of the effective dielectric constant of the superstrate across the antenna aperture to reduce or eliminate surface waves and/or standing waves in the superstrate, and thus power loss, and increase antenna performance.

2. Discussion of the Related Art

Current wireless communications systems, including radio frequency systems, global positioning systems (GPS), cellular telephone systems, personal communications systems (PCS), etc., typically require broadband antennas that are compact in size, low in weight and inexpensive to produce. Currently, radio frequency systems use the 20–400 MHz range, GPS use the 1–1.5 GHz range, cellular telephone systems use the 900 MHz range, and PCS use the 1800–2000 MHz range. The antennas receive and transmit electromagnetic signals at the frequency band of interest associated with the particular communications system in an effective manner to satisfy the required transmission and reception functions. Different communications systems require different antenna optimization parameters and design concerns to satisfy the performance expectations of the system.

The antennas necessary for the above-mentioned communications systems pose unique problems when implemented on a moving vehicle. The transmission and reception of electromagnetic waves into and out of a vehicle for different communications systems is generally accomplished through several antennas usually in the form of metallic masts protruding from the vehicle's body. However, mast antennas have significant drawbacks in this type of environment. In a typical design, the linear dimensions of a monopole mast antenna are directly proportional to the operational wavelength $\lambda$ of the system, and are usually a quarter wavelength for high performance purposes. Thus, at the lower end of the frequency spectrum, the size of a high-efficiency antenna becomes prohibitively large. For example, a monopole mast antenna used in the 800 MHz range should be around 10 cm long. Current military wireless communications systems use HF/UHF/VHF frequency bands, in addition to cellular telephone systems, GPS and PCS. For military communications in the 20 MHz range, the size of a high performance antenna is in the 4 m range. For military vehicles, mast antennas increase the vehicle's radar visibility, and thus reduce its survivability.

Further, when using multiple antennas to satisfy several communications systems, electromagnetic interference (EMI) between the antennas may become a problem. If the antennas are formed on a common substrate, the antenna signals tend to couple to each other and deteriorate the system's performance and signal-to-noise ratio. Thus, the design of multifunction antennas for military and commercial vehicles tends to pose major challenges with regard to the antenna size, radiation efficiency, fabrication costs, as well as other concerns.

To obviate the drawbacks of mast antennas, it is known in the art to employ planar antennas, including slot, microstrip, and aperture type designs, all well known in the art, for a variety of communications applications in the above-mentioned frequency bands, primarily due to the simplicity, conformability, low manufacturing costs and the availability of design and analysis software for such antenna designs. FIG. 1 shows a perspective view of a planar slot ring antenna 10 depicting this type of design, and is intended to represent all types of planar antenna designs. The ring antenna 10 includes a substrate 12 and a conductive metallized layer 14 printed on a top surface of the substrate 12. The layer 14 is patterned by a known patterning process to etch out a ring 16, and define a circular center antenna element 18 and an outside antenna element 20 on opposite sides of the ring 16. The antenna elements 18 and 20 are excited and generate currents by received electromagnetic radiation for reception purposes, or by a suitable transmission signal for transmission purposes, that create an electromagnetic field across the ring 16. A signal generator 22 is shown electrically connected to an antenna feed element 24 patterned on an opposite side of the substrate 12 from the layer 14. The signal generator 22 generates the signal for transmission purposes and receives the signal for reception purposes.

The antenna 10 is a slot antenna because no conductive plane is provided opposite to the layer 14. This allows the antenna 10 to operate with a relatively wide operational bandwidth compared to a metal-backed antenna configuration. However, the absence of a metallic ground plane results in radiation into both sides of the antenna, hence, bidirectional operation. In order to direct the radiation into one side of the antenna (unidirectionality), a high dielectric constant superstrate can be employed. FIG. 2 shows a cross-sectional view of the antenna 10 where a superstrate 26 having a high dielectric constant $\in_r$ has been positioned on the layer 14, opposite to the substrate 12, to direct the radiation through the superstrate 26. The higher the dielectric constant $\in_r$ of the superstrate 26, the more directional the antenna 10.

In addition to providing unidirectionality, a high dielectric constant superstrate also leads to antenna size reduction. The linear dimensions of planar antennas are directly proportional to the operational wavelength of the system. The transmission wavelength $\lambda$ of electromagnetic radiation propagating through a medium is determined by the relationship:

$$\lambda = \frac{C}{f\sqrt{\epsilon_r}} \tag{1}$$

where C is the speed of light, f is the frequency of the radiation and $\in_r$ is the relative dielectric constant or relative permittivity of the medium. For air, $\in_r=1$. In this context, the dielectric constant $\in_r$ and the index of refraction n can be used interchangeably, since $\in_r=n^2$. To significantly reduce the size of the antenna 10 for miniaturization purposes at a particular operational wavelength, it is known to position the superstrate 26 adjacent the layer 14 and make the superstrate 26 out of a high dielectric constant material, so that when the electromagnetic radiation travels through the superstrate 26, the wavelength is decreased in accordance with equation (1). This is because the guided wavelength along the antenna elements 18 and 20 is inversely proportional to the square root of the effective dielectric constant $\in_{eff}$, which in turn is related to the relative dielectric constant $\in_r$ of the superstrate 26. The exact relationship depends on the particular geometry of the elements of the antenna 10. The dimensions of the antenna 10 would be well known to those skilled in the art for particular frequency bands of interest. By continually increasing the dielectric constant $\in_r$, the size of the antenna 10 can be further reduced for operation at a particular frequency band.

The use of a high dielectric constant superstrate is highly effective in reducing the size of the antenna so that it is practical for many high and low frequency communications applications. However, the use of high dielectric constant superstrates has a major drawback. It is known that planar antenna designs that employ high index substrates or superstrates have a significantly degraded performance due to the generation of surface waves and resonant or standing waves within the substrate or superstrate. These waves are generated because electromagnetic waves are reflected by dielectric interfaces, and are eventually trapped in the substrate 12 or superstrate 26 in the form of surface waves. The trapped waves carry a large amount of electromagnetic power along the interface and significantly reduce the radiated power from the antenna 10. The power carried by the excited surface waves is a function of the substrate characteristics, and increases with the dielectric constant of the substrate 12 or the superstrate 26. Additionally, the substrate 12 and/or superstrate 26 have the dimensions that cause standing waves within these layers as a result of resonance at the operational frequencies that also adversely affects the power output of the electromagnetic waves.

Consequently, an antenna printed on or covered by a high index material layer of the type described above, may have one or more of low efficiency, narrow bandwidth, degraded radiation pattern and undesired coupling between the various elements in array configurations. A few approaches have been suggested in the art to resolve the excitation of substrate modes in these types of materials, either by physical substrate alterations, or by the use of a spherical lens placed on the substrate 12. In all cases, the radiation efficiency is increased and antenna patterns are improved considerably as a result of the elimination of the surface wave propagation. However, all of these implementations have either resulted in non-monolithic designs or have been characterized by large volume and intolerable high costs.

The need to eliminate and/or reduce surface waves and standing waves in the superstrate region of a planar antenna of the type discussed above is critical for high antenna performance. To reduce these waves, it has been proposed by two of the inventors to replace the superstrate 26 with a planar superstrate having a graded index of refraction. The superstrate is formed from high index of refraction composite materials that are graded along one or both of the axial and radial directions. This concept is disclosed in provisional patent application 60/086701, filed May 26, 1998, titled "Multifunction Compact Planar Antenna With Planar Graded Index Superstrate Lens." By grading the dielectric constant of the superstrate 26 in one or both of the axial and radial directions, the electromagnetic waves propagating through the superstrate 26 encounter dielectric interfaces that alter the symmetry of the superstrate 26, and prevents the standing waves. Because of the lensing action of the superstrate 26, surface waves associated with traditional planar antennas printed on high index materials are suppressed causing the antenna efficiencies to increase dramatically.

FIGS. 3 and 4 depict this design by showing a cross-sectional view of the antenna system 10 that has been modified accordingly. In FIG. 3, the superstrate 26 has been replaced with a superstrate graded index lens 30 including three dielectric layers 32, 34 and 36 made from three materials with different dielectric constants so that the lens 30 is graded in the axial direction. The superstrate lens 30 is graded in a manner such that the layer 32 closest to the layer 14 has the highest dielectric constant, and the layer 36 farthest from the layer 14 has the lowest dielectric constant to gradually match the dielectric constant to free space. This design shows three separate dielectric layers 32–36 having different dielectric constants, but of course, more than three layers having different levels of grading can also be provided.

FIG. 4 shows a cross-sectional view of the antenna system 10 where the superstrate lens 26 has been replaced by a superstrate graded index lens 38 including three separate concentric dielectric sections 40, 42 and 44 having different dielectric constants to provide for grading in the radial direction. As above, three separate sections 40–44 are shown for illustration purposes, in that other sections having different dielectric constants can also be provided. With this design, the center section 40 has the highest dielectric constant and the outer section 44 has the lowest dielectric constant. In an alternate embodiment, the antenna system 10 can be graded in both the axial and radial directions in this manner. The lens material would be a suitable low-loss composite or thermally formed polymer. The lens 30 and 38 provide for size reduction of the antenna system 10, while providing high antenna performance by eliminating undesirable substrate modes. The radial grading of the lens would allow for the elimination of surface waves, while the axial grading would provide gradual matching of the antenna to free space to further enhance radiation efficiency.

The graded index superstrate lens design discussed above is effective for eliminating or reducing surface waves, but is limited in its operating frequency range because of current manufacturing capabilities of the lens. Particularly, the grading of the lens material is currently carried out using injection molding processes, where a composite material is injected into a host material with a varying volume fraction to achieve the desired permittivity profile. From an electrical point of view, this process introduces material losses, which become pronounced as the frequency increases. For a frequency range of interest covering FM radio bands through GPS and PCS (f<2 GHz), the material processing technique is able to provide satisfactory performance. However, for higher frequencies at C-band or X-band and higher, providing the necessary material technology is out of reach at the present time. Also, the mechanical assembly of the graded index lens using machining and processing techniques have proven to be relatively costly and not amenable to mass production.

What is needed is a superstrate lens for a planar antenna that provides a varying effective dielectric constant profile across the lens to eliminate surface and standing waves for increased performance, but does not suffer from the limitations manufacturing referred to above. It is therefore an object of the present invention provide such a superstrate lens.

SUMMARY OF THE INVENTION

In accordance with the teachings of the present invention, a planar antenna is disclosed that includes a high dielectric superstrate lens having a plurality of air voids to control the effective dielectric constant of the material of the lens. The voids can take on any shape and configuration in accordance with a particular antenna design scheme so as to optimize the effective dielectric constant for a particular application. In one particular design, the voids are vertical air holes, whose diameters have to be less than 1/20th of the operational wavelength of the antenna. The holes act to control the variation of the effective dielectric constant of the superstrate lens so that resonant waves do not form in the lens, thus reducing power loss in the antenna. A suitable low cost mechanical or laser drilling process can be used to form the holes.

Additional objects, advantages, and features of the present invention will become apparent from the following description and appended claims, taken in conjunction with the accompanying drawings.

DETAILED DESCRIPTION OF THE PREFERRED EMBODIMENTS

The following discussion of the preferred embodiments directed to a planar antenna including a superstrate lens having air voids that provide an effective dielectric constant is merely exemplary in nature, and is in no way intended to limit the invention or its applications or uses.

In accordance with the present invention, a new class of superstrate lenses used in connection with planar antennas are disclosed that provide the functionality of the graded index lens discussed in the 60/086701 provisional application, but avoid frequency-limited material processing methods that are used to make the graded index lens. The design of the invention includes forming holes or voids in a high dielectric superstrate lens by a mechanical or laser micromachining drilling technique to alter the effective dielectric constant of the lens. In other words, by introducing air holes into the superstrate lens, the effective dielectric constant of the lens is reduced from the actual dielectric constant of the material of the lens. Providing sections with different effective dielectric constants in the superstrate lens increases antenna performance suppresses the surface wave and resonant wave modes in the lens. This process is also aided by axial variations of the hole density, which provides a good match between the dielectric and air media. As a result, the power that would be trapped by the surface waves is released, improving power efficiency. The present invention improves power efficiency by employing high index superstrates through unidirectional radiation. The high index superstrate also provides size reduction or miniaturization of the antenna. The result is a planar antenna with low radar cross section and high radiation efficiency. In addition, the suppression of surface waves will improve the performance of common platform designs by minimizing interelement coupling in arrays or multifunction antennas.

Any irregularity in the material discontinuity of the superstrate lens that is distributed and small compared to the operational wavelength of the antenna can be incorporated into the macroscopic treatment of the electromagnetic phenomena by modifying the overall dielectric constant of the lens medium. In fact, the process may be quantified by comparing it to a uniform material having the effective dielectric constant that would electromagnetically behave in the same manner. The overall effective dielectric constant of the lens can be controlled by adjusting the size and the density of the holes. The higher the dielectric constant of the host material, the larger the range of effective dielectric constants that can be produced.

Figure 1:
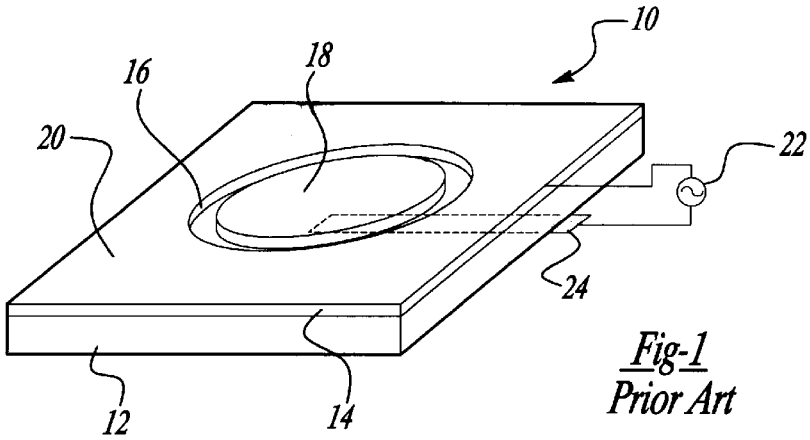
Fig-1 Prior Art
FIG. 1 is a perspective view of a known planar slot ring antenna.
Figure 2:
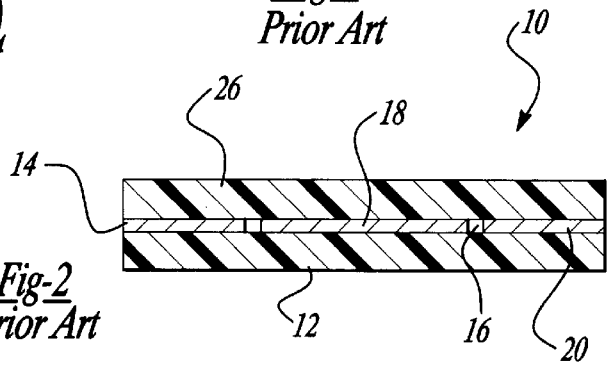
Fig-2 Prior Art
FIG. 2 is a cross-sectional view of another known planar slot ring antenna including a superstrate lens.
Figure 3:
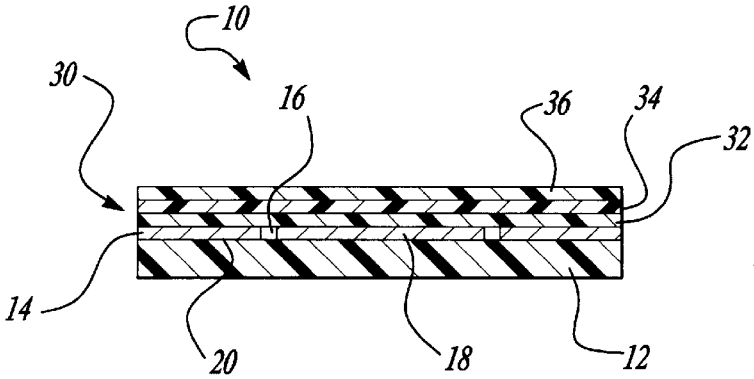
FIG. 3 is a cross-sectional view of a planar slot ring antenna including a graded index superstrate lens that is graded in an axial direction.
Figure 4:
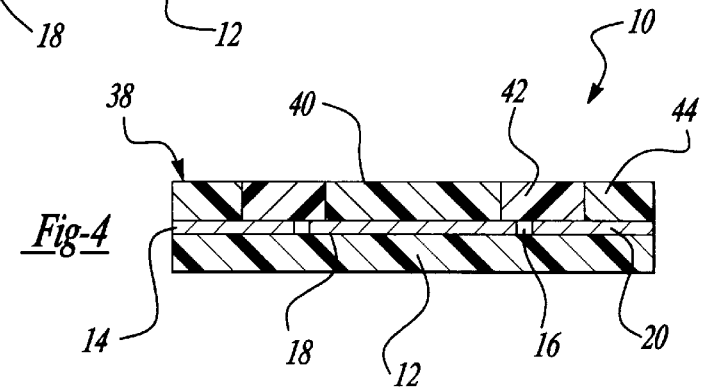
FIG. 4 is a cross-sectional view of a planar slot ring antenna including a graded index superstrate lens that is graded in a radial direction.
Figure 5:
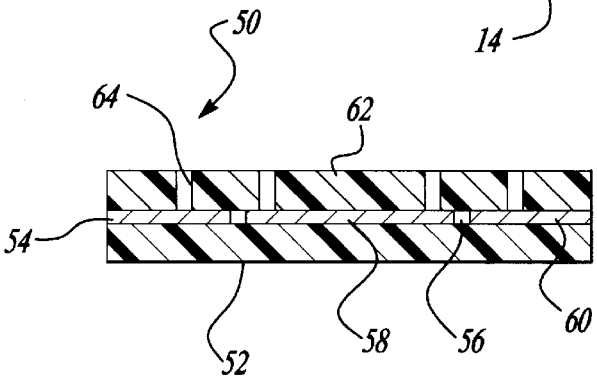
FIG. 5 is a cross-sectional view of a planar slot ring antenna including a superstrate lens having a spatially designed configuration of circular holes that change the effective dielectric constant of the lens, according to an embodiment of the present invention.

FIG. 5 shows a cross-sectional view of a planar slot ring antenna 50, similar to the antenna 10 discussed above, that illustrates the concept of the present invention. The antenna 50 includes a substrate 52 and a conductive metallized layer 54 printed on a top surface of the substrate 52. The layer 54 is patterned by a suitable patterning process to etch out a slot ring 56, and define a circular center antenna element 58 and an outside antenna element 60 on opposite sides of the ring 56. The antenna elements 58 and 60 are excited and generate currents by the received electromagnetic radiation for reception purposes, or by a suitable signal for transmission purposes, that creates an electromagnetic field across the ring 56.

Figure 6:
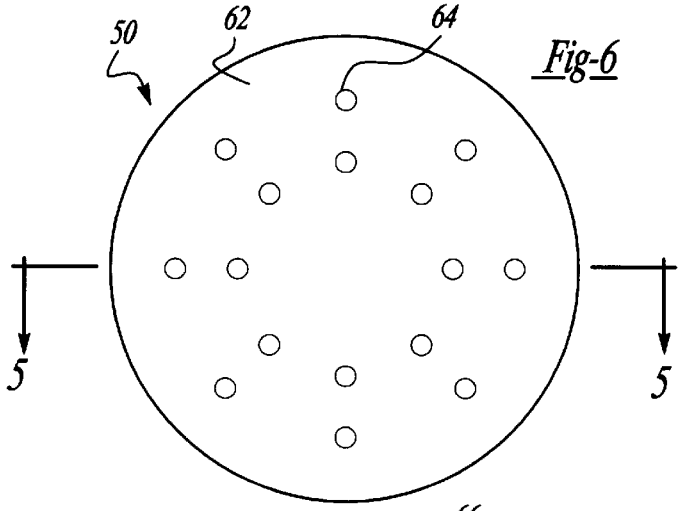
FIG. 6 is a top view of the superstrate lens shown in FIG. 5.

A high dielectric constant superstrate lens 62 is positioned on top of the layer 54, and provides the same function of miniaturization and directionality as the superstrate lenses discussed above. The lens 62 can be made of any suitable material, such as polymers, ceramics, thermoplastics, and their composites. In accordance with the teachings of the present invention, a series of air holes 64 are formed through the lens 62 in a predetermined configuration. A top view of the antenna 50 is shown in FIG. 6 to depict a typical pattern of the holes 64. Because the dielectric constant $\in_r$ of air is one, the combined dielectric constant of the entire lens 62 effectively becomes less than the actual dielectric constant of the material of the lens 62.

Figure 7:
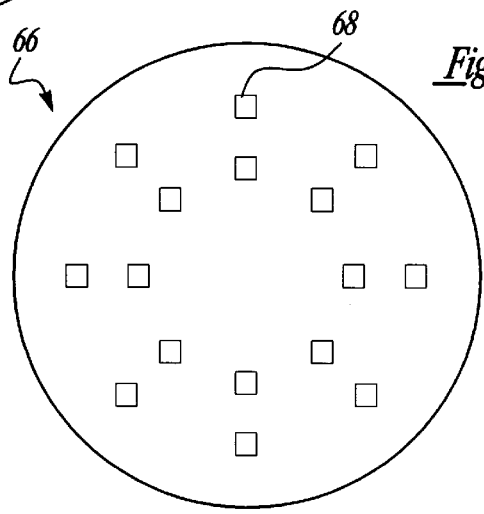
FIG. 7 is a top view of a superstrate lens having square holes, according to another embodiment of the present invention.

The holes 64 are shown in a predetermined symmetrical configuration, and extend completely through the lens 62. In alternate designs, the holes 64 may only extend through a portion of the thickness of the lens 62, and may be randomized, or specially designed in accordance with a suitable optimization scheme. Also, the holes can have different shapes. FIG. 7 shows an alternate design of a superstrate lens 66 that can replace the lens 62 including square holes 68, according to another embodiment of the present invention. The shape of the holes would be determined for each particular application based on the performance requirements, and can have any realistic shape, such as circular, square, triangular, diamond, etc., as would be appreciated by those skilled in the art. Also, the holes 64 may be closed and filled with a different injected material having a predetermined dielectric constant.

By altering the dielectric constant of the superstrate lens in this manner, the manufacturing costs of the lens is considerably lower and simpler than the graded technique, and does not involve sophisticated material processing techniques. Therefore, a much higher operating frequency can be achieved. Artificial dielectrics provide an inexpensive and efficient process to realize compact common aperture antennas with multifunction capabilities that can perform at very high frequencies. The only limitation is that the irregularities or holes in the lens should be small compared to the operational wavelength. For practical purposes, a diameter of 1/20th of the operational wavelength qualifies for a "small" size. At X-band frequencies, for example, the wavelength is on the order of 3 cm, and thus the holes should be no larger than 1.5 mm, which can comfortably be achieved using a mechanical drill. For higher frequencies, laser micromachining technology is available. It is stressed, that any combination of hole designs and patterns can be provided within the scope of the present invention, as long as the size of the holes conform with the wavelength requirements of the operational frequency of the antenna.

Figure 8A:
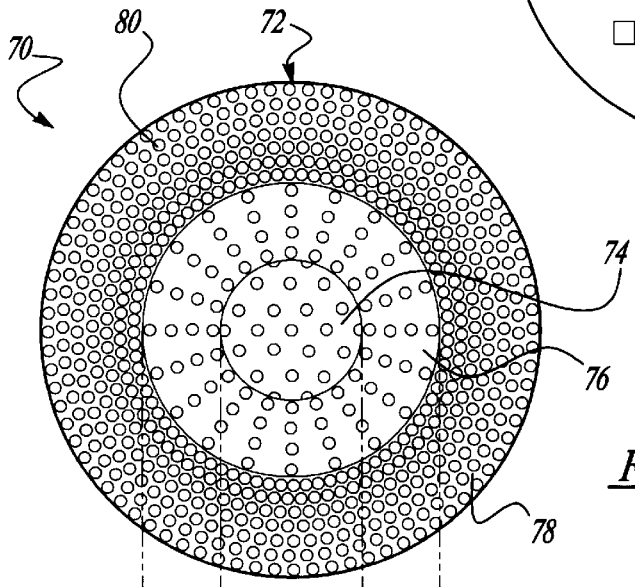
FIG. 8(*a*) shows a top view and FIG. 8(*b*) shows a cross-sectional view of a planar antenna including a superstrate lens having separate sections of different hole densities to control the variation of the effective dielectric constant, according to another embodiment of the present invention.
Figure 8B:
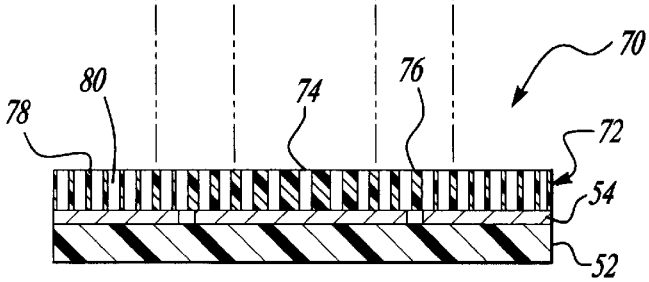

The planar superstrate lens can be designed to have sections of different hole densities in the radial (and/or axial) direction, according to the invention. This embodiment is depicted in FIGS. 8(*a*) and 8(*b*) showing a top view and a cross-sectional view, respectively, of a planar slot ring antenna 70 similar to the antenna 50 discussed above, where like elements are referenced the same. The slot ring antenna 70 includes a superstrate lens 72 that is separated into three concentric sections 74, 76 and 78. Each of the sections 74–78 has a different hole density defined by holes 80 to alter the effective permittivity of the lens 72 radially out from the center of the antenna 70 towards free space. In this specific design, the effective permittivity of the superstrate lens 72 decreases farther away from the center so as to provide the same type of grading index as discussed above in the 60/086,701 provisional application. Alternatively, a superstrate lens can be provided that includes different lens layers extending axially out from the antenna slot to provide a decrease in the effective permittivity and axial direction, as also discussed in this application.

Figure 9:
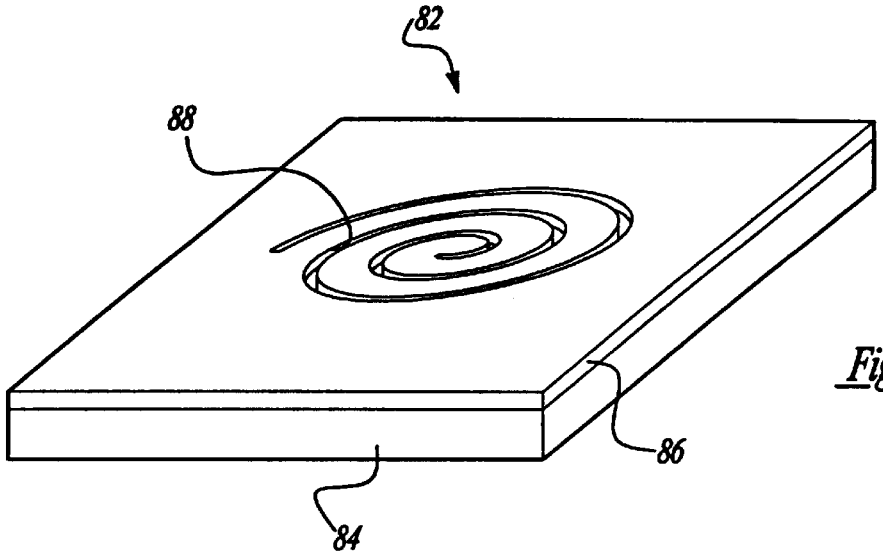
FIG. 9 is a perspective view of a planar spiral slot antenna.

The antenna 50 discussed above includes the slot ring 56 to depict the general concept of the present invention. Of course, use of a superstrate lens including a plurality of openings that alter the effective dielectric constant of the lens, according to the invention, can be used in connection with other antenna designs. FIG. 9 shows a perspective view of a planar spiral slot antenna 82 including a substrate 84 and a metallized layer 86 that has been patterned to form a spiral slot 88. Planar spiral slot antennas of this type are known to those skilled in the art. The various embodiments of the superstrate lens 62 can be used in connection with the antenna 82 for the same purposes, as discussed above. FIG. 9 is intended to illustrate that other types of planar antennas can be used in connection with the superstrate lens of the invention.

Figure 10:
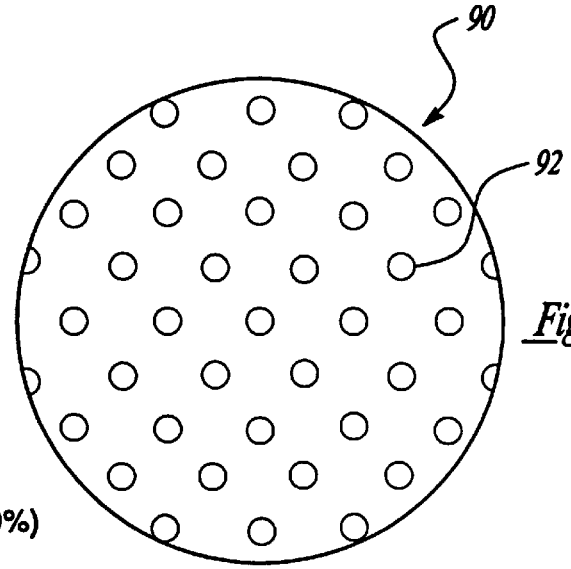
FIG. 10 shows a top view of a superstrate lens for a planar antenna of the invention depicting a random pattern of holes to provide an effective dielectric constant.

FIG. 10 shows a top view of an artificial dielectric lens 90 including a plurality of vertical holes 92 to depict a simulation geometry for demonstrating the effective permittivity of a superstrate lens of the invention. The lens 90 can be used for miniaturization, as well as for providing a unidirectional radiation pattern. In this simulation, a slot loop antenna having an inner diameter of 3 cm and a width of 0.1875 cm was used in connection with the lens 90. The lens 90 is 1.5 cm thick with a diameter of 4.5 cm and would be centered on top of the loop antenna. The antenna resonates at a frequency of 1.073 GHz, where the free space wavelength is 28 cm. The miniaturization effect is evident from the small size of the antenna/lens combination. The near field of the structure has been solved using the finite element method and the volume mesh has been truncated using a lossy dielectric layer backed by a PEC. The slot loop was excited using an ideal electric current source. The actual dielectric constant of the material of the superstrate lens 90 is 36, and the vertical holes 92 were formed through the lens 90 to control the overall effective dielectric constant to be between 36 and 1. The volume percentage of air in the lens 90 is given by $100N\ (D_h/D_d)^2$, where N is the number of holes 92, $D_h$ is the diameter of the holes 92, and $D_d$ is the diameter of the lens 90.

Figure 11:
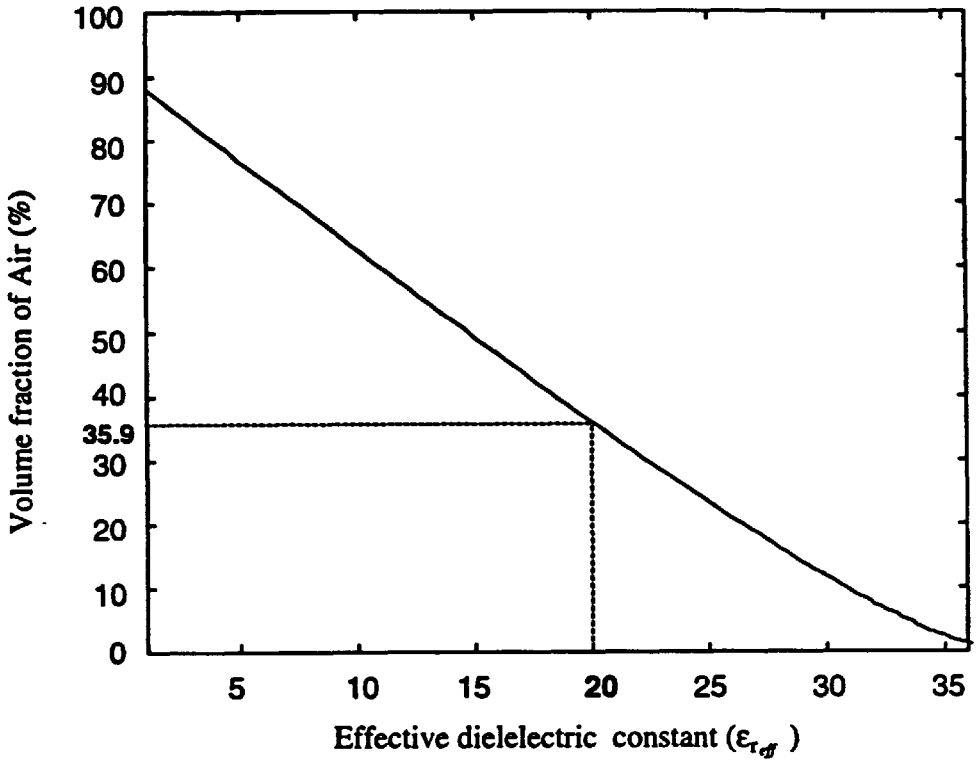
FIG. 11 is a graph with the effective dielectric constant of the lens on the horizontal axis and volume fraction of air of the lens on the vertical axis to show the relationship of hole density volume fraction to the effective dielectric constant of the superstrate lens of FIG. 10 based on resonance frequency.

When the lens 90 is used for achieving a unidirectional pattern, the ability to control the dielectric constant becomes important as it provides a means to control the front-to-back ratio (FBR) of the antenna. The FBR is the ratio of power transmitted through the superstrate lens 90 relative to the power transmitted to the substrate. As the dielectric constant of the superstrate lens 90 increases, the FBR should also increase. To relate the volume fraction of air to the effective permittivity, the front-to-back ratio (FBR) of the antenna was recorded for various hole densities, and a polynomial curve was fitted to relate the FBR to the volume fraction of air. Then, a uniform solid lens was used with different values of permittivity and the FBR was recorded again, with another polynomial curve fitted to relate the FBR to the uniform dielectric constant. Finally, the FBR variable was eliminated from the two curves to directly relate the volume fraction to the effective dielectric constant for the same value of the FBR, as shown in FIG. 11. The dashed line in the graph shows that to realize an effective dielectric constant of 20, a volume fraction of 35.9% is needed. FIG. 11 clearly shows that an effective dielectric constant can be simulated by forming holes in a high permittivity material. The higher the density of the holes, the lower the effective dielectric constant of the lens. This provides a cost-effective way of achieving arbitrary values of dielectric constants.

Figure 12:
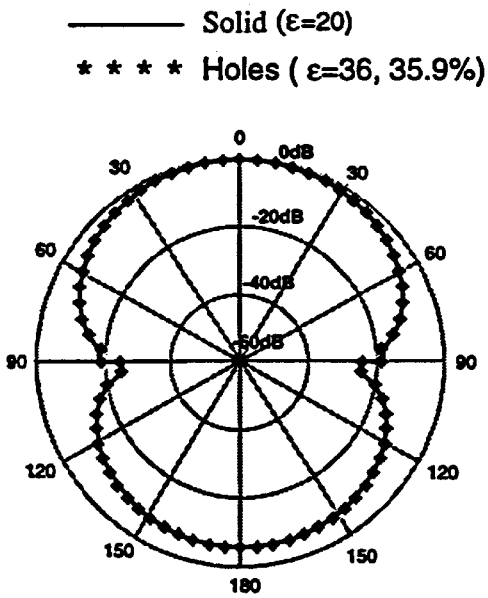
FIG. 12 is a graph showing radiation patterns comparing the performance two equivalent antennas, one including a superstrate lens with $\in_r$=36 and having air voids with a volume fraction of 35.9% and a corresponding solid superstrate lens with a uniform $\in_r$=20.

To verify the equivalence between a high permittivity lens having a plurality of holes and a uniform solid lens with an effective dielectric constant, the far field radiation pattern of the antenna/lens combination was calculated for two cases: (1) with the lens 90 of FIG. 10 having a diameter of 4.5 cm, a thickness of 1.5 cm, a permittivity of 36 and the holes 92 having a volume fraction of 35.9%, and (2) with a solid lens of exactly the same dimensions but with a uniform permittivity of 20. FIG. 12 shows the radiation pattern of the two cases at the resonant frequency. It is seen that a front-to-back ratio of 5.3 dB and 5.2 dB is achieved in the two cases, respectively. Even the two patterns follow each other very closely for all angles.

Figure 13:
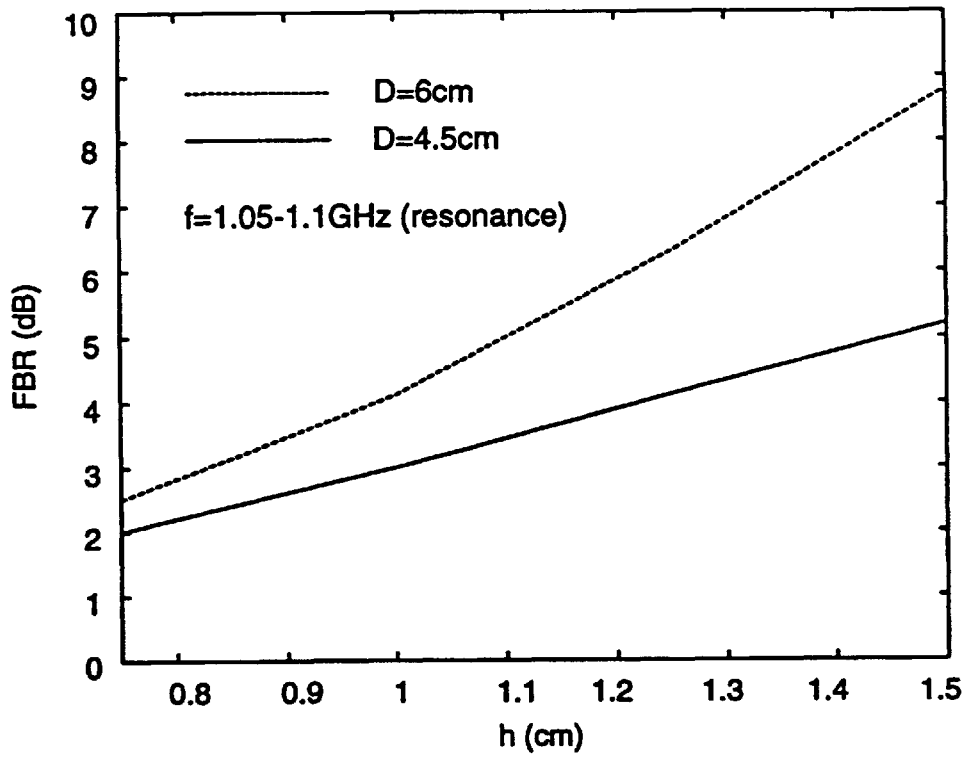
FIG. 13 is a graph showing the lens thickness on the horizontal axis and the front-to-back ratio (FBR) of the antenna on the vertical axis.

The radiation efficiency of the antenna increases by increasing the front-to-back ratio. The FBR is directly proportional to the volume of the superstrate lens 90. FIG. 13 shows the variation of the FBR as a function of the thickness of the lens 90 for two different values of the lens diameter, namely 4.5 cm and 6 cm. It is seen that for same lens thickness of 1.5 cm, an FBR of 8.8 dB can be achieved if the diameter of the lens 90 is increased to 6 cm with the same dimensions of the slot antenna. This indicates that there is a trade-off between the efficiency and antenna gain and miniaturization. Given the design specifications and requirements, a minimum antenna size can be established to maintain a minimum gain requirement.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A planar antenna system comprising:

a substrate;

a planar antenna patterned on the substrate, said antenna operating at a predetermined frequency band; and a superstrate lens positioned on the antenna opposite to the substrate and being made of a superstrate material having a material dielectric constant, said superstrate lens including a plurality of holes that vary the material dielectric constant to be an effective dielectric constant that acts to reduce resonant waves in the superstrate lens.

2. The antenna system according to claim 1 wherein the superstrate material is selected from the group consisting of polymers, ceramics, thermoplastics and their composites.

3. The antenna system according to claim 1 wherein the opening of each of the holes has an average lateral dimension less than about one-twentieth of the wavelength at a center frequency of the predetermined frequency band.

4. The antenna system according to claim 1 wherein the holes are dispersed across the superstrate lens in a random manner.

5. The antenna system according to claim 1 wherein the holes re dispersed across the superstrate lens in a predetermined symmetrical configuration.

6. The antenna system according to claim 1 wherein the holes extend completely through the superstrate lens.

7. The antenna system according to claim 1 wherein the superstrate lens is separated into a plurality of radial sections where each section includes a different pattern of holes.

8. The antenna system according to claim 1 wherein the shape of the holes is selected from any predetermined shape.

9. The antenna system according to claim 1 wherein the planar antenna is selected from the group consisting of slot ring antennas and slot spiral antennas.

10. The antenna system according to claim 1 wherein the substrate is made of a material having a lower dielectric constant than the effective dielectric constant.

11. The antenna system according to claim 1 wherein the frequency band is selected from the group consisting of cellular telephone, GPS, PCS and radio frequency bands.

12. The antenna system according to claim 1 wherein the planar antenna is patterned from a metallized layer formed on the substrate.

13. The antenna system according to claim 1 wherein the holes are formed in the superstrate lens by a drilling process.

14. The antenna system according to claim 1 wherein the superstrate lens is cylindrical.

15. The antenna system according to claim 1 wherein the superstrate lens includes a stack of separate lens sections, each having a plurality of holes but with different hole distributions.

16. The antenna system according to claim 1 wherein the holes in the superstrate are filled with a material that is different from the lens material.

17. The planar antenna system comprising:

a substrate having a substrate dielectric constant;

a planar slot antenna patterned on the substrate, said slot antenna being operational at a predetermined frequency band having an operational wavelength; and a superstrate lens positioned on the antenna opposite to the substrate and being made of a superstrate material having a material dielectric constant, being a ceramic composite, said superstrate lens including a plurality of micromachined holes extending through the lens that vary the material dielectric constant to be an effective dielectric constant that acts to reduce resonant waves in the superstrate lens, said holes having an average diameter less than 1/20th of the wavelength at a center frequency of the predetermined frequency band.

18. The antenna system according to claim 17 wherein the holes are dispersed across the superstrate lens in a random or symmetrical manner.

19. The antenna system according to claim 17 wherein the holes extend completely through the superstrate lens.

20. The antenna system according to claim 17 wherein the superstrate lens is separated into a plurality of radial sections where each section includes a different pattern of holes.

21. The antenna system according to claim 17 wherein the frequency band is selected from the group consisting of cellular telephone, GPS, PCS and radio frequency bands.

22. The antenna system according to claim 17 wherein the planar antenna is patterned from a metallized layer formed on the substrate.

23. The antenna system according to claim 17 wherein the superstrate lens is cylindrical.

24. The antenna system according to claim 17 wherein the slot antenna is selected from the group consisting of a ring slot antenna and a spiral slot antenna.

25. A method of providing a planar antenna system, comprising:

providing a substrate;

patterning a planar antenna on the substrate to operate at a predetermined frequency band;

providing a superstrate lens on the antenna opposite to the substrate that is made out of a superstrate material having a material dielectric constant; and forming a plurality of holes in the superstrate lens to vary the material dielectric constant to be an effective dielectric constant that acts to reduce resonant waves in the superstrate lens.

26. The method according to claim 25 wherein forming the holes includes forming the holes to have an average opening dimension less than about 1/20th of the wavelength at a center frequency of the predetermined frequency band.

27. The method according to claim 25 wherein forming the holes includes forming the holes in a random or symmetrical manner across the superstrate lens.

28. The method according to claim 25 wherein forming the holes includes forming the holes completely through the superstrate lens.

29. The method according to claim 25 wherein forming the holes includes separating the superstrate lens into a plurality of radial sections and forming holes to have different patterns in each section.

30. The method according to claim 25 wherein providing a planar antenna includes providing a slot ring antenna or a slot spiral antenna.

31. The method according to claim 25 wherein forming the holes in the superstrate lens includes forming the holes by a mechanical drilling process.

* * * * *